US009193421B1

(12) United States Patent
Bliss

(10) Patent No.: US 9,193,421 B1
(45) Date of Patent: Nov. 24, 2015

(54) SAFETY DEVICE TO QUICKLY LOCATE A DROWNING VICTIM

(71) Applicant: Pamela Bliss, South Attleboro, MA (US)

(72) Inventor: Pamela Bliss, South Attleboro, MA (US)

( * ) Notice: Subject to any disclaimer, the term of this patent is extended or adjusted under 35 U.S.C. 154(b) by 0 days.

(21) Appl. No.: 14/120,703

(22) Filed: Jun. 18, 2014

Related U.S. Application Data

(60) Provisional application No. 61/956,891, filed on Jun. 20, 2013.

(51) Int. Cl.
*B63C 9/08* (2006.01)
*B63C 9/15* (2006.01)

(52) U.S. Cl.
CPC ..... *B63C 9/155* (2013.01)

(58) Field of Classification Search
USPC ..... 441/113, 112, 6, 122
IPC ..... B63C 9/155
See application file for complete search history.

(56) References Cited

U.S. PATENT DOCUMENTS

| | | | | |
|---|---|---|---|---|
| 1,935,229 | A | 11/1933 | Neil | |
| 4,560,356 | A * | 12/1985 | Burr | 441/80 |
| 5,954,556 | A * | 9/1999 | Powers | 441/88 |
| 6,394,866 | B1 | 5/2002 | Brown | |
| 2004/0033740 | A1 * | 2/2004 | Jones | 441/122 |

* cited by examiner

*Primary Examiner* — Stephen Avila

(57) ABSTRACT

An ejectable floatation device includes a foldable inflatable cell coupled to a compressed gas cartridge. The inflatable cell includes a tether with one end attached to the inflatable cell and the opposite end attached to the user. The inflatable cell fits within a pocket encapsulating the ejectable floatation device, and is made buoyant upon actuation by the user of compressed gas. The inflated cell exits the pocket floating to the waters surface while still being attached to the user to identify his/her position in the water. The pocket encapsulating the ejectable floatation device may be formed on a waistband or armband or the like.

7 Claims, 9 Drawing Sheets

SAFETY DEVICE TO QUICKLY LOCATE A DROWNING VICTIM

CROSS-REFERENCE TO RELATED APPLICATIONS

This application claims the benefit of U.S. Provisional Application No. 61/956,891 filed 20 Jun. 2013.

FIELD OF THE INVENTION

This invention relates to a floatation type safety device, more particularly, to an arm float or safety belt which contains an ejectable buoy for quickly locating a drowning victim underwater who must be pulled out and given immediate first aid and medical care.

BACKGROUND OF THE INVENTION

It is well known that many persons drown every year, especially children who are subject to accidentally falling into relatively deep water where they cannot be located quickly enough to be rescued and revived. Accidental drownings often occur during family picnics or similar outings near a body of water such as a lake, pond or river, where young children who are poor or inexperienced swimmers fall into the water and suddenly disappear without any visible trace. Even experienced swimmers who are fishermen, boating enthusiasts or scuba divers may fall overboard and be subjected to the sudden shock of cold water which could cause unconsciousness so that they cannot swim but instead sink down into the water. Workers on bridges or waterfront structures may be injured or knocked unconscious just before falling into the water so as to be unable to save themselves.

These unfortunate circumstances arise all to frequently, and although the best safety precaution is to wear a buoyant safety vest or the like, such garments are relatively expensive and interfere with normal activities so that many persons will not wear them. A few safety devices have been proposed for use by swimmers or bathers where a buoy is releasably attached to a holder worn on the body of the person in the water, the buoy preferably being released by the victim when in fear of drowning. Two such devices were disclosed almost 50 years ago by Neal, U.S. Pat. No. 1,935,229 (1933) and Carlbeck, U.S. Pat. No. 1,955,053 (1934), but require relatively complex and expensive structures making it difficult to encourage their purchase and use.

It is a principal object of the present invention to provide a simple, inexpensive and unobtrusive safety device which can be readily attached to a potential drowning victim, including small children, through an armband or waist belt. The device may be worn in the water and includes an actuator allowing for the wearer to manually activate the device when required. The device is to be made from readily available parts to be affordable, readily useable and even reusable. Due to its small size and lightness in weight, the device can be affixed within an armband, or waist band or the like where it will not interfere with a person's normal activities while submerged in the water.

SUMMARY OF THE INVENTION

In accordance with one embodiment of the present invention, an armband embodying an ejectable floatation device is disclosed. The ejectable floatation device includes a foldable inflatable cell coupled to a compressed gas cartridge. The inflatable cell includes a tether with one end attached to the inflatable cell and the opposite end attached to the armband. The armband is elastic and fits over a users forearm and includes a pocket encapsulating the ejectable floatation device. The armband includes an opening in the top of the pocket to allow the folded inflatable cell, upon inflation via puncturing of the compressed gas cartridge, to exit the armband and float to the waters surface while still being attached to the user to identify his/her position in the water. The compressed gas is released into the inflatable cell by pulling a cord coupled to a pin actuator which punctures the gas cartridge. The ejectable floatation device can also be embodied in a waist strap or the like.

DETAILED DESCRIPTION OF THE INVENTION

The following detailed description illustrates the invention by way of example and not by way of limitation. This description will clearly enable one skilled in the art to make and use the invention, and describes embodiments, adaptations, variations, alternatives and uses of the invention, including what I presently believe is the best mode of carrying out the invention. As various changes could be made in the above constructions without departing from the scope of the invention, it is intended that all matter contained in the above description or shown in the accompanying drawings shall be interpreted as illustrative and not in a limiting sense.

In view of the foregoing, it will be seen that the several objects of the invention are achieved and other advantageous results are obtained.

Figure 1:
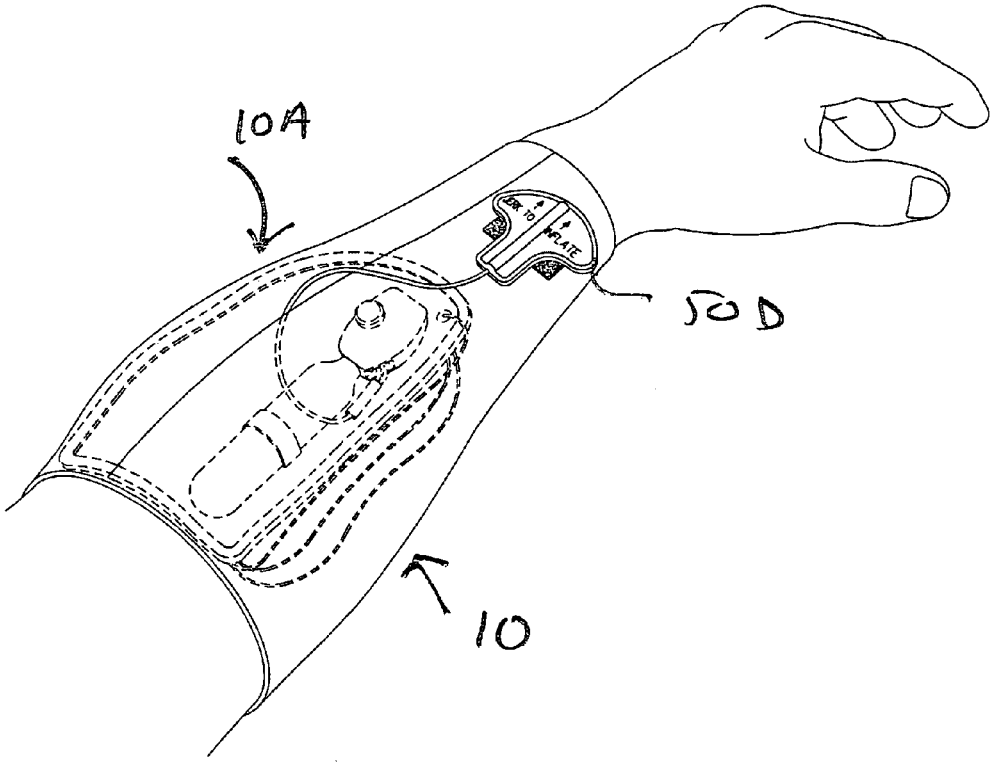
FIG. 1 illustrates a perspective view of a Safety Device to Quickly Locate a Drowning Victim, embodied in an arm band having an inflatable cell.
Figure 2:
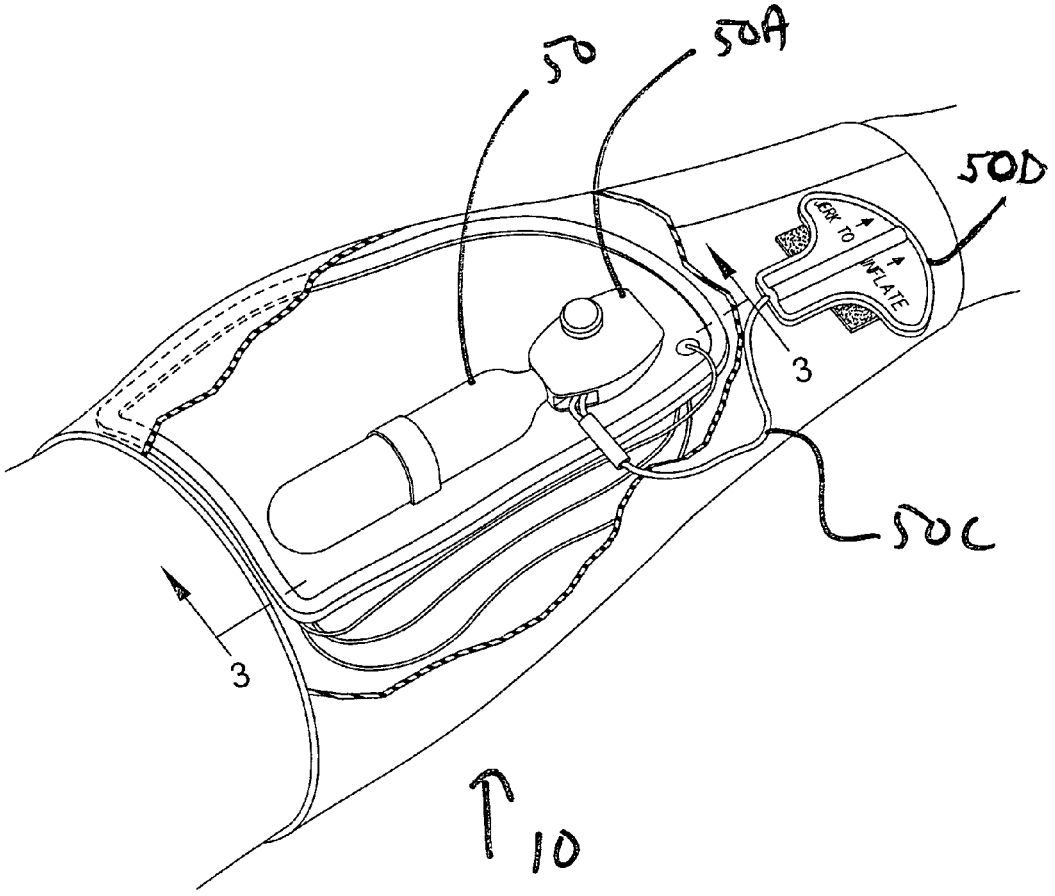
FIG. 2 illustrates an alternate view of the safety device of FIG. 1.
Figure 3:
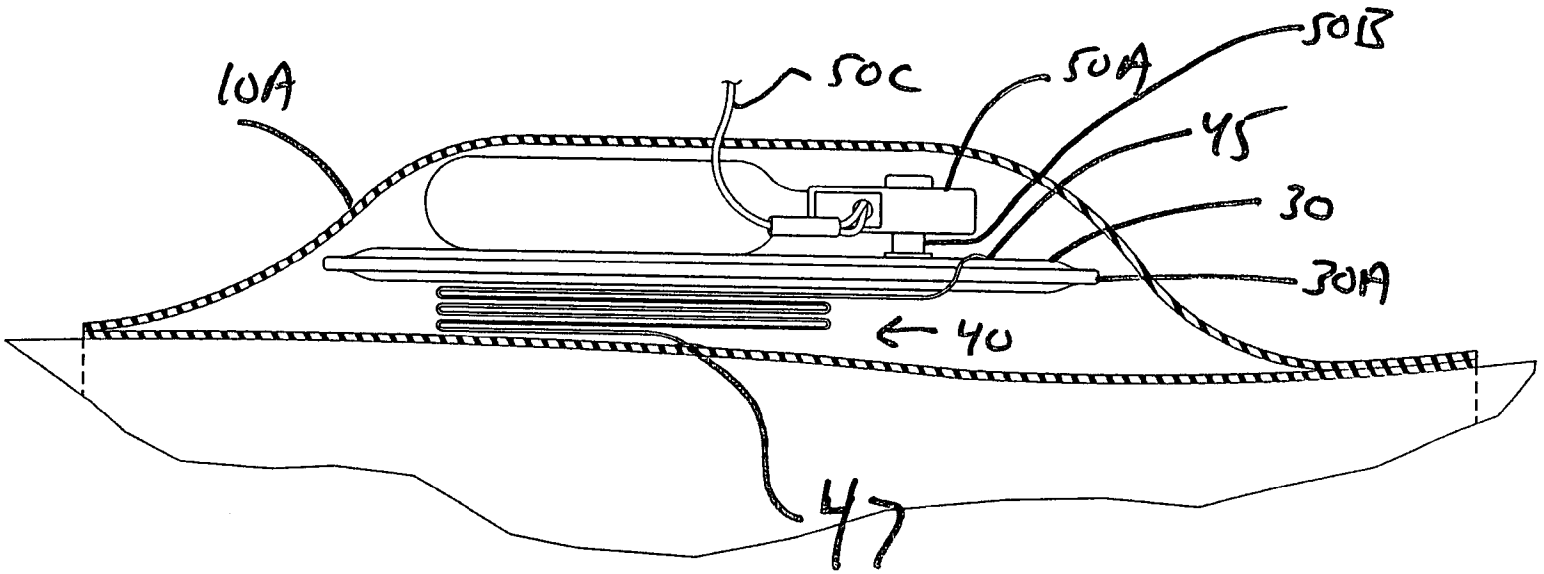
FIG. 3 illustrates a cross sectional view of the safety device of FIG. 1.

Referring FIGS. 1 and 2, an embodiment of the present invention is illustrated, depicting an ejectable floatation device 100 embodied in an armband 10. Referring to FIG. 3, the armband 10 includes a pocket 10A encapsulating the ejectable floatation device. The ejectable floatation device includes compressed gas cartridge 50 coupled to actuator 50A which is coupled to inflate valve 50B. Actuator 50A is operable by pulling cord 50C which releases an internal pin movable to puncture cartridge 50.

Upon puncture, compressed gas is released through inflate valve 50B into inflatable cell 30. Cartridge 50, actuator 50A, and inflate valve 30 are affixed externally to inflatable cell 30, and can be changed out for repeated use of the safety device. Inflatable cell is foldable to fit within pocket 10A and includes an inlet (not shown) for a hermetic fit of inflate valve 50B therein. Inflatable cell 30 may contain a rim 30A for assembly of the inflatable cell.

Figure 4:
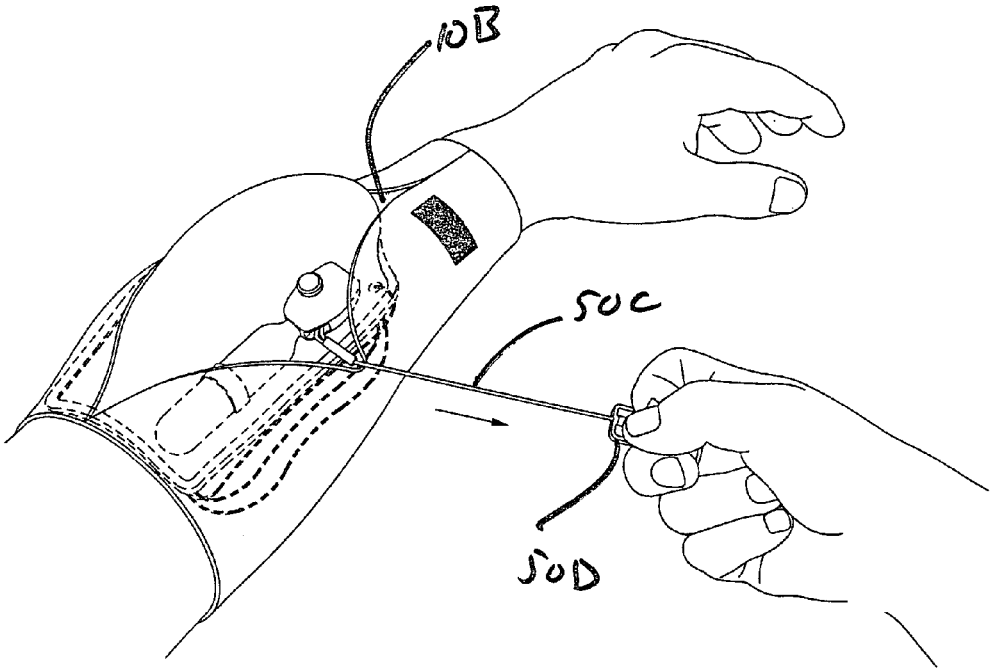
FIG. 4 illustrates the safety device of FIG. 1 just subsequent to the tether being pulled and the interior inflatable cell starting to be filled with gas and exiting the armband pocket.
Figure 5:
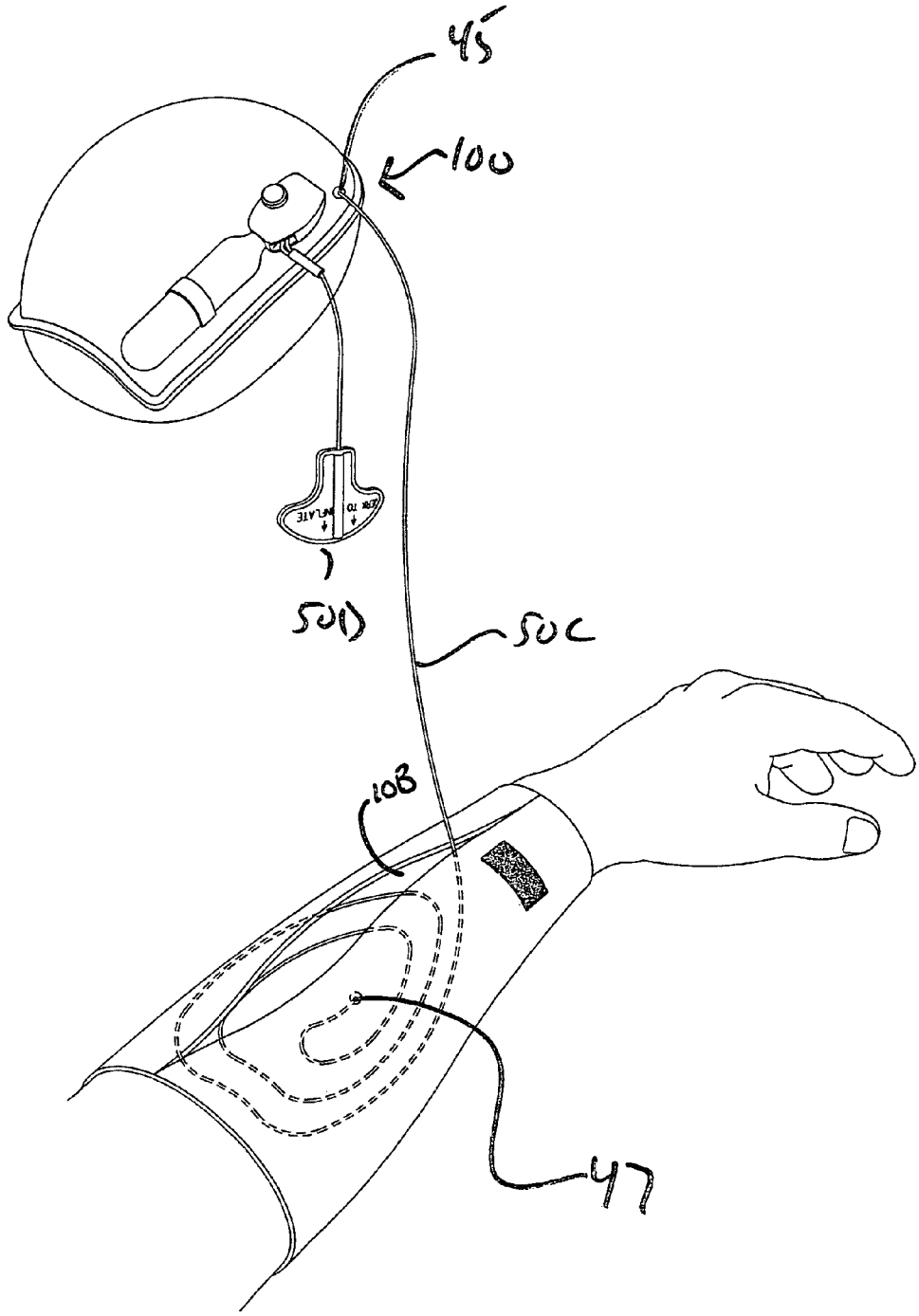
FIG. 5 illustrates the inflatable cell of FIG. 4 being fully filled with compressed gas having exited the armband pocket.
Figure 6:
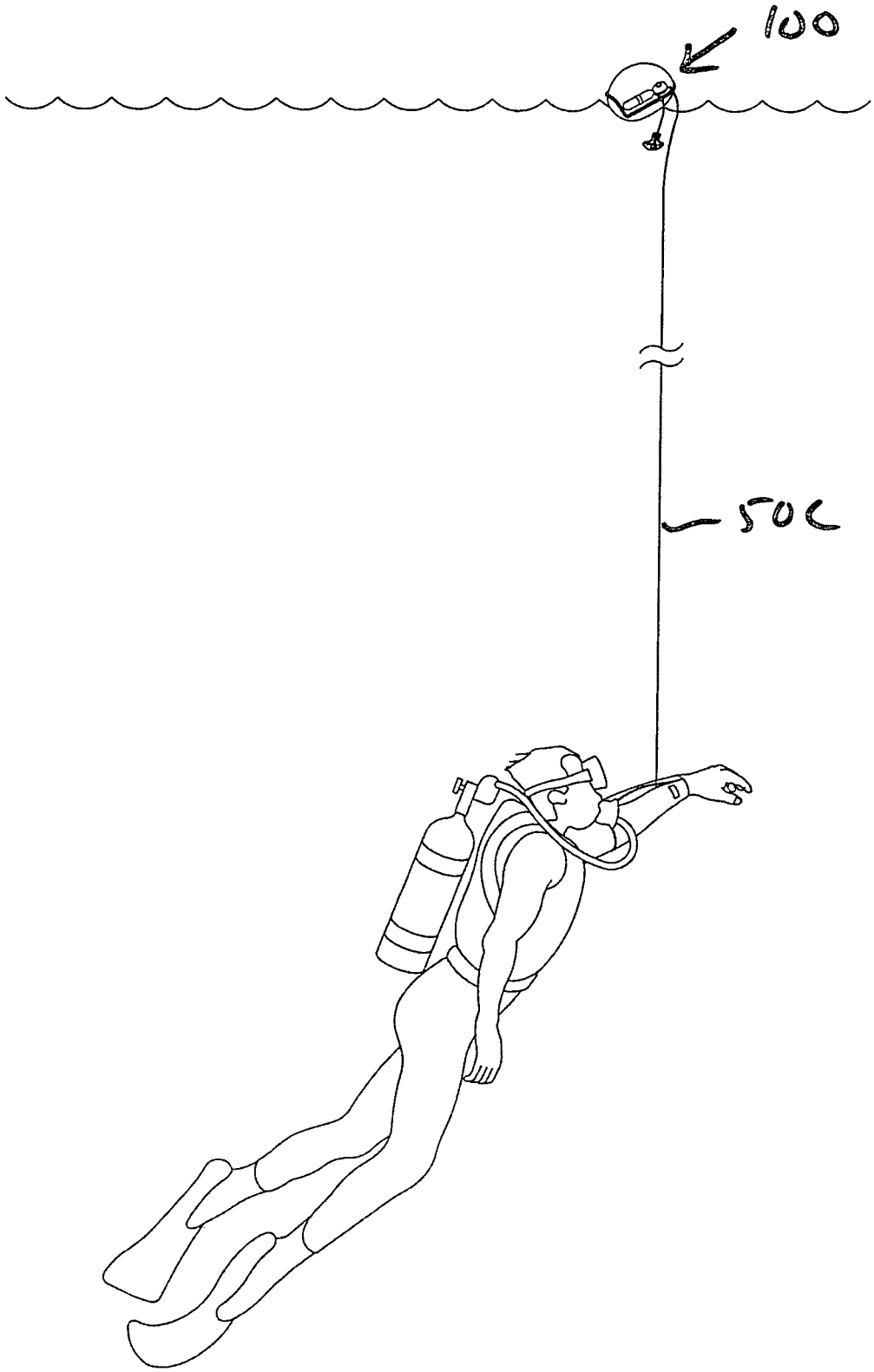
FIG. 6 illustrates the inflatable cell of FIG. 5 having floated to the surface of the water.

The components of ejectable floatation device are arranged within the pocket 10A as follows: first, a tether 40, adaptable to be coiled, is connected at a first end 45 to the inflatable cell 30 and to a second end 47 at the base of pocket 10A. The tether 40 is coiled and rests on the base of the pocket 10A. A folded inflatable cell 30 rests on top of the coiled tether 40, and the compressed gas cartridge 50 actuator 50A coupled to the inflatable cell 30, rests on the folded inflatable cell 30, pointed upward in the direction of slit 10B of pocket 10A. Referring to FIGS. 1 and 4, cord 50C exits pocket 10A through a slit 10B. Slit 10B can include cross-cuts necessary to provide an unobstructed cord release. Cord 50C includes a grasping tab 50D which can be velcroed to armband 10. Slit 10B extends the length of pocket 10A, and the pocket 10A material can be made of neoprene or like material being resiliently flexible.

The pocket material is dimensioned to securely hold the contents therein. Further, after the cord 50C is pulled, and the floatation device is inflated, the resiliently flexible material expands outward from slit 10B in response to inflatable cell 30 being filled with compressed air. The force of the now buoyant cell 30 separates slit 10 B. Further, as illustrated in FIG. 4, Slit 10B is separated to further facilitate the exit of inflatable cell 30, by the pulling of cord 50C via grasping tab 50D.

Figure 7:
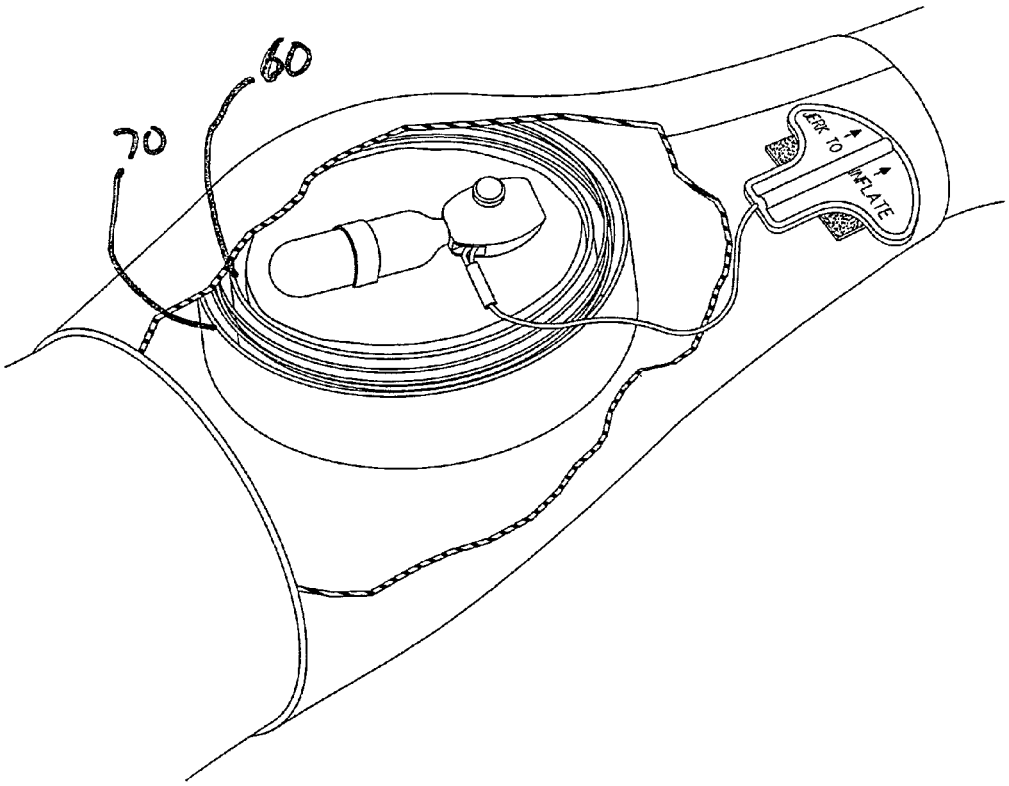
FIG. 7 illustrates an alternative embodiment of FIG. 1.

FIG. 7 illustrates an alternative embodiment of the present invention having the ejectable floatation device fitted within a circular wall 60 and a second concentric circular wall 70. In this embodiment, the tether line 40 is coiled between the two concentric walls for precise release upon inflatable cell 30 being released.

Figure 8:
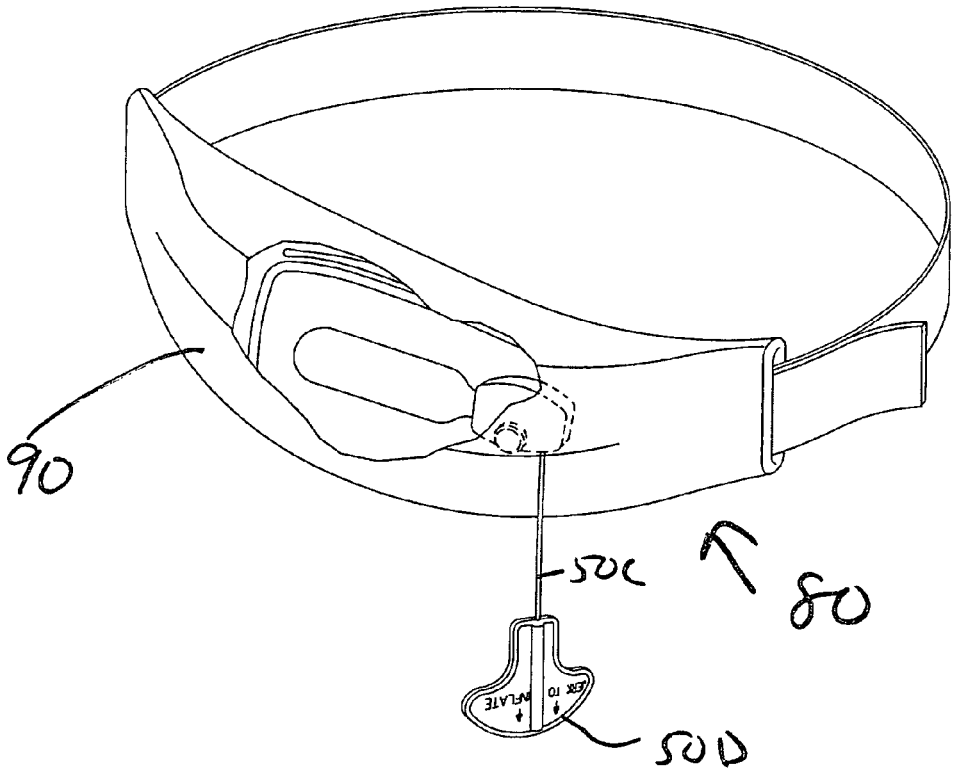
FIG. 8 illustrates a Safety Device to Quickly Locate a Drowning Victim, embodied in a waist band and having an inflatable cell.
Figure 9:
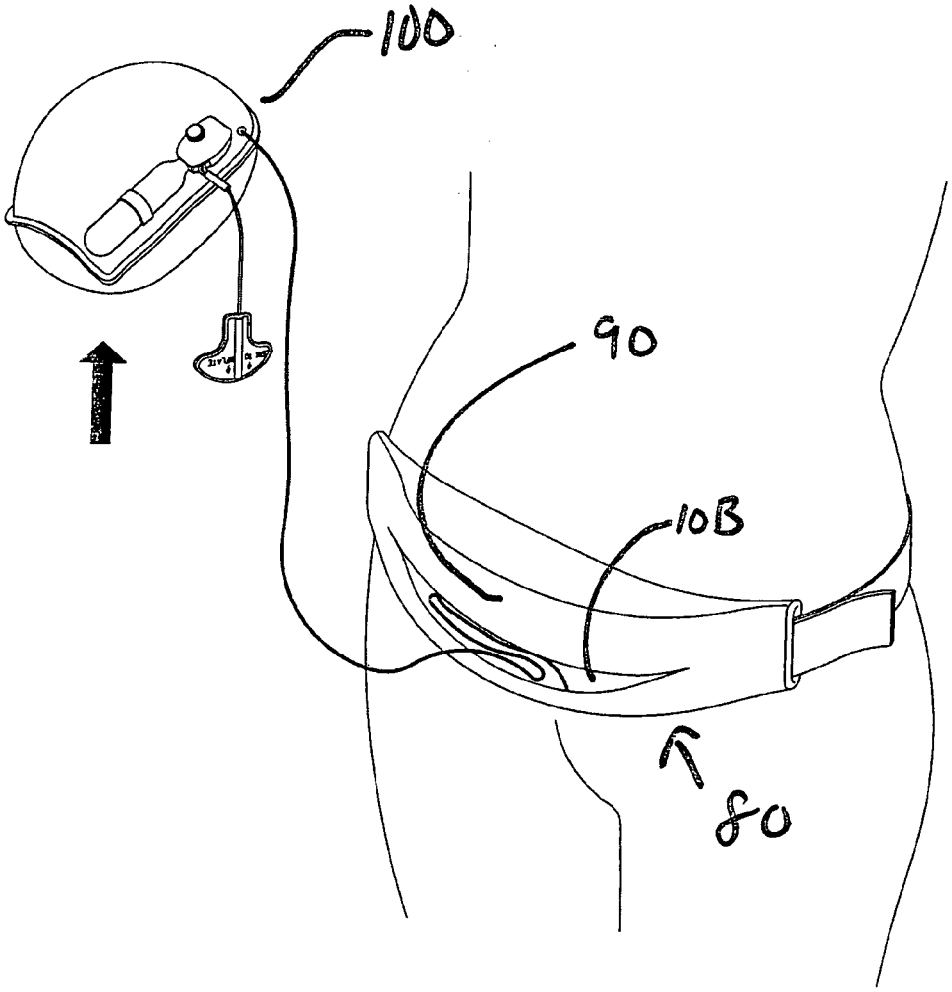
FIG. 9 illustrates the embodiment of FIG. 8, where the inflatable cell is filled with compressed gas then exits the waist band pocket.

FIG. 8 and FIG. 9 illustrate an alternative embodiment of subject invention embodied in a waist band 80. The waistband includes a Waistband pocket 90 as similarly described above which contains the ejectable floatation device components as described above.

I claim:

1. A safety device attached to a user and ejectable underwater to rise to the surface to identify the location of the user, comprising:

A pocket separable at its center;

a floatation device ejectable underwater and removably mounted in said pocket, said ejectable floatation device capable of deflation and folding in a compact manner within said pocket, said ejectable floatation device including a tether attached at one end to said ejectable floatation device and at the opposite end to the interior of said pocket, said ejectable floatation device capable of being inflated by the user, said inflated floatation device becoming buoyant causing said separable pocket to separate and said buoyant floatation device to exit therethrough, said ejectable flotation device and said tether rising to the surface to identify the location of the user, wherein said ejectable floatation device further includes an inflatable cell, said inflatable cell including a compressed gas cartridge coupled to said inflatable cell, a gas cartridge actuator coupled to said compressed gas cartridge, said actuator having a pin movable to puncture said gas cartridge when said ejectable floatation device is inflated by said user, wherein said actuator pin is movable by a cord, said cord having one end attached to said actuator, and a second end attached to said user, and wherein said cord exits said pocket through said separable center, and wherein said cord facilitates the separation of said pocket at its center when said cord is pulled.

2. A safety device as in claim 1, wherein said compressed gas cartridge, and said gas cartridge actuator are located on the exterior surface of said inflatable cell.

3. A safety device as in claim 1, wherein said pocket of said belt is made of a resiliently flexible material.

4. A safety device as in claim 3, wherein said material is neoprene.

5. A safety device as in claim 1, wherein said pocket is formed on an armband.

6. A safety device as in claim 1, wherein said pocket is formed on a waistband.

7. A safety device as in claim 1, wherein said cord is adaptable to be coiled within said pocket.

* * * * *